US006681019B1

(12) United States Patent
Kitano et al.

(10) Patent No.: US 6,681,019 B1
(45) Date of Patent: Jan. 20, 2004

(54) POLARITY DETERMINING CIRCUIT FOR LOUDSPEAKERS, AN AUDIO CIRCUIT HAVING A FUNCTION OF DETERMINING POLARITIES OF LOUDSPEAKERS, AND AN AUDIO CIRCUIT HAVING FUNCTIONS OF DETERMINING POLARITIES OF LOUDSPEAKERS AND SWITCHING THE POLARITIES

(75) Inventors: Mikio Kitano, Hamamatsu (JP); Takatsugu Uragami, Tokyo (JP)

(73) Assignees: Yamaha Corporation, Hamamatsu (JP); Kabushiki Kaisha Daiichikosho, Tokyo (JP)

( * ) Notice: Subject to any disclaimer, the term of this patent is extended or adjusted under 35 U.S.C. 154(b) by 0 days.

(21) Appl. No.: 09/400,236

(22) Filed: Sep. 21, 1999

(30) Foreign Application Priority Data

Sep. 22, 1998 (JP) ..... 10-286085

(51) Int. Cl.[7] ..... H04R 29/00
(52) U.S. Cl. ..... 381/59; 381/123; 381/96
(58) Field of Search ..... 381/59, 96, 1, 381/107, 123, 56, 58, 97, 98, 104

(56) References Cited

U.S. PATENT DOCUMENTS 4,908,868 A 3/1990 McTaggart
5,319,714 A 6/1994 McTaggart
5,666,424 A * 9/1997 Fosgate et al. ..... 381/107

FOREIGN PATENT DOCUMENTS

JP 59-12367 1/1984
JP 6311578 11/1994

* cited by examiner

*Primary Examiner*—Minsun Oh Harvey
(74) *Attorney, Agent, or Firm*—Pillsbury Winthrop LLP

(57) ABSTRACT

A test signal generator (10) outputs a test signal which is obtained by cutting off a high-frequency component from a white noise signal. A signal switching device (18) selectively outputs either one of a positive-phase signal of the test signal and a negative-phase signal of the test signal, in response to a switching operation of the user. A selector (16) selectively outputs either one of the test signal and a musical sound signal to speaker terminals (26, 28). The test signal is reproduced while the selector (16) is connected to the test signal side. At this time, the test signal is output as it is from one channel. A signal which is obtained by selectively outputting either one of the positive-phase signal of the test signal and the negative-phase signal of the test signal is reproduced from the other channel. If, when the test signal is positive-phase, the sound is localized between the left and right loudspeakers, the connection polarities of the left and right loudspeakers is attained. If, when the test signal is negative-phase, the sound is localized between the left and right loudspeakers, coincidence of the connection polarities of the left and right loudspeakers is not attained (i.e., connection polarity of one of the loudspeakers is reversed).

3 Claims, 4 Drawing Sheets

POLARITY DETERMINING CIRCUIT FOR LOUDSPEAKERS, AN AUDIO CIRCUIT HAVING A FUNCTION OF DETERMINING POLARITIES OF LOUDSPEAKERS, AND AN AUDIO CIRCUIT HAVING FUNCTIONS OF DETERMINING POLARITIES OF LOUDSPEAKERS AND SWITCHING THE POLARITIES

BACKGROUND OF THE INVENTION

1. Field of the Invention

The present invention relates to a circuit which determines whether or not the connection polarities of left and right loudspeakers connected to a stereo amplifier or the like coincide with those of the stereo amplifier, an audio circuit having such a determining function, and an audio circuit having a function of, when coincidence of the connection polarities fails to be attained, switching over the polarities.

The present application is based on Japanese Patent Application No. Hei. 10-286085, which is incorporated herein by reference.

2. Description of the Related Art

In a stereo reproduction system, the polarities of left and right loudspeakers must be coincident with those of speaker terminals of a stereo amplifier. The state of coincidence of the connection polarities of left and right loudspeakers means a state where all of plus and minus terminals of left and right loudspeakers are respectively connected to plus and minus speaker terminals of left and right channels of an amplifier or the like in a perfectly coincident manner, or in a completely reversed manner. The state of incoincidence of the connection polarities of left and right loudspeakers means a state where plus and minus terminals of one of left and right loudspeakers are respectively connected to plus and minus speaker terminals of the one of left and right channels of an amplifier or the like in a coincident manner and plus and minus terminals of the other one of the left and right loudspeakers are respectively connected to the plus and minus speaker terminals of the other one of left and right channels of the amplifier in a reversed manner.

As a method of determining whether or not coincidence of the connection polarities of left and right loudspeakers are attained, known is a method in which one test signal is reproduced from both the left and right loudspeakers. When the reproduced sound is localized at the midpoint between the left and right loudspeakers, the reproduced sounds of the left and right loudspeakers are positive-phase, and it is therefore determined that coincidence of the connection polarities of the loudspeakers is attained. The connections of the loudspeakers are not required to be changed. By contrast, when the reproduced sound is localized outside the left and right loudspeakers, the reproduced sounds of the left and right loudspeakers are negative-phase, and it is therefore determined that incoincidence of the connection polarities of the loudspeakers occurs. The connection polarity of the loudspeaker of one channel must be reversed.

In the above determining method, it is difficult to determine whether or not coincidence of the connection polarities of left and right loudspeakers is attained because of the following reasons.

(a) Problem due to absolute evaluation: Only one sound is used in determining whether the sound is positive-phase or negative-phase, and hence the determination is based on absolute evaluation. Since there is no reference for comparison, skills are required for the determination.

(b) Problem due to standing wave: In the case where a test signal having only one frequency component is used, when the frequency is close to that of the standing wave of the room, interference between the test signal and the standing wave causes polarities to be incorrectly determined.

(c) Problem due to arrangement of loudspeakers: When a test signal has a higher signal, the wavelength is shorter. In the case where the distances between the discriminator and left and right loudspeakers are different from each other, a difference of one half wavelength causes negative-phase, and a difference of one wavelength causes positive-phase. For example, a signal of 1 kHz has a wavelength of 1 msec. Since the velocity of sound is 340 m/sec, the wavelength corresponds to a distance of 34 cm. A difference of such a distance easily occurs depending on the placement of loudspeakers or the listening position. In the case of a karaoke apparatus, particularly, loudspeakers are often placed in a bilaterally asymmetrical manner, and hence this problem easily occurs.

In the related art, it is difficult to determine whether or not coincidence of the connection polarities of left and right loudspeakers is attained because of the above reasons. Only a skilled person can correctly conduct the determination.

SUMMARY OF THE INVENTION

It is an object of the present invention to provide a polarity determining circuit for loudspeakers, and an audio circuit having functions of determining polarities of loudspeakers and switching the polarities which can solve the problems of the related art and which can easily and correctly determine whether or not coincidence of the connection polarities of left and right loudspeakers is attained.

The polarity determining circuit for loudspeakers of the present invention comprises: a test signal generator which generates a test signal; a signal switching device which, based on a switching operation of a user, selectively outputs either one of a positive-phase signal of the test signal and a negative-phase signal of the test signal; and left and right speaker terminals; wherein an output signal of the signal switching device is output from one of the left and right speaker terminals, and one of the positive-phase and negative-phase signals of the test signal is constantly output from the other of the left and right speaker terminals.

According to the polarity determining circuit, based on a switching operation of the user, the test signal can be reproduced while being switched to positive-phase or negative-phase for one of the left and right channels. Therefore, relative evaluation can be conducted by comparing the test signals of positive-phase and negative-phase with each other. Consequently, it is possible to easily determine whether the reproduced sound is localized between left and right loudspeakers (i.e., coincidence of the connection polarities of the left and right loudspeakers is attained) or outside the loudspeakers (i.e., coincidence is not attained).

An audio circuit having a function of determining polarities of loudspeakers of the present invention comprises: a test signal generator which generates a test signal; a signal switching device which, based on a switching operation of a user, selectively outputs either one of a positive-phase signal of the test signal and a negative-phase signal of the test signal; a selector which, based on a selecting operation of the user, selectively outputs either one of an output test signal of the signal switching device and a musical sound signal of one of left and right channels, as a signal of the one of the left and right channels, and which, interlocked with the output, selectively outputs either one of a constant output which is one of the positive-phase and negative-phase signals of the test signal, and a musical sound signal of another one of the left and right channels, as a signal of the other one of the left and right channels; and left and right speaker terminals from which the output signals of the left and right channels of the selector are respectively output.

According to the audio circuit, the test signal and the musical sound signal can be selectively output from the selector. In polarity determination using the test signal, when it is determined that coincidence of the connection polarities of the left and right loudspeakers is not attained, the connection between the speaker terminals of one of the left and right channels and the loudspeaker of the one of the left and right channels is changed (namely, the connection polarity is reversed), whereby coincidence of the connection polarities of the left and right loudspeakers can be attained.

The audio circuit having functions of determining polarities of loudspeakers and switching the polarities of the present invention comprises: a test signal generator which generates a test signal; a first signal switching device which, based on a switching operation of a user, selectively outputs either one of a positive-phase signal of the test signal and a negative-phase signal of the test signal; a selector which, based on a selecting operation of the user, selectively outputs either one of an output test signal of the first signal switching device and a musical sound signal of one of left and right channels, as a signal of the one of the left and right channels, and which, interlocked with the output, selectively outputs either one of a constant output which is one of the positive-phase and negative-phase signals of the test signal, and a musical sound signal of another one of the left and right channels, as a signal of the other one of the left and right channels; a second signal switching device which, based on the switching operation of the user, selectively outputs either one of a positive-phase signal of the output signal of the one of the left and right channels of the selector, and a negative-phase signal of the output signal; and left and right speaker terminals from which the output signal of the second signal switching device and the output signal of the other one of the left and right channels of the selector are respectively output.

According to the audio circuit, the test signal and the musical sound signal can be selectively output from the selector. In polarity determination using the test signal, when it is determined that coincidence of the connection polarities of the left and right loudspeakers is not attained, switchover of positive-phase/negative-phase is conducted by the second signal switching device on the side of the output of the selector, thereby enabling coincidence of the connection polarities of the left and right loudspeakers to be attained without changing connections between the speaker terminals and the loudspeakers.

The other audio circuit having functions of determining polarities of loudspeakers and switching the polarity of the present invention comprises: a test signal generator which generates a test signal; a first signal switching device which, based on a switching operation of a user, selectively outputs either one of a positive-phase signal of the test signal and a negative-phase signal of the test signal; a second signal switching device which, based on a selecting operation of the user, selectively outputs either one of a positive-phase signal of a musical sound signal of one of left and right channels and a negative-phase signal of the musical sound signal; a selector which, based on the selecting operation of the user, selectively outputs either one of an output signal of the second signal switching device, and the output test signal of the first signal switching device, that is, a constant output which is one of positive-phase and negative-phase signals of the test signal, as a signal of the one of the left and right channels, and which, interlocked with the output, selectively outputs either one of a musical sound signal of another one of the left and right channels, and a constant output which is one of the positive-phase and negative-phase signals of the test signal, that is, the output test signal of the first signal switching device, as a signal of the other one of the left and right channels; and left and right speaker terminals from which the output signals of the left and right channels of the selector are respectively output.

According to the audio circuit, the test signal and the musical sound signal can be selectively output from the selector. In polarity determination using the test signal, when it is determined that coincidence of the connection polarities of the left and right loudspeakers is not attained, switchover of positive-phase/negative-phase is conducted by the second signal switching device on the side of the input of the selector, thereby enabling coincidence of the connection polarities of the left and right loudspeakers to be attained without changing connections between the speaker terminals and the loudspeakers. In this case, the operation of the second signal switching device for switching over positive-phase/negative-phase of the musical sound signal can be interlocked with that of the first signal switching device for switching over positive-phase/negative-phase of the test signal (an interlocked operation is conducted so that, when the first signal switching device is positive-phase, the second signal switching device is also positive-phase, and, when the first signal switching device is negative-phase, the second signal switching device is also negative-phase). According to this configuration, when coincidence of the connection polarities of the left and right loudspeakers is attained by means of the first signal switching device using the test signal, the signals of the left and right channels are then switched to the musical sound signals so that the loudspeakers are used as they are.

The further audio circuit having functions of determining polarities of loudspeakers and switching the polarity of the present invention comprises: a test signal generator which generates a test signal; a selector which, based on a selecting operation of a user, selectively outputs either one of the test signal and a musical sound signal of one of left and right channels, as a signal of the one of the left and right channels, and which, interlocked with the output, selectively outputs either one of the test signal and a musical sound signal of another one of the left and right channels, as a signal of the other one of the left and right channels; a signal switching device which, based on a switching operation of the user, selectively outputs either one of a positive-phase signal of the output signal of the one of the left and right channels of said selector, and a negative-phase signal of the output signal; and left and right speaker terminals from which the output signal of said signal switching device and the output signal of the other one of the left and right channels of said selector are respectively output.

According to the audio circuit, polarity determination and polarity switching can be simultaneously conducted by the single signal switching device on the side of the output of the selector.

The test signal generator used in the present invention may comprise, for example, a white noise generator which generates a white noise signal, and a low-pass filter which receives the white noise signal, and which extracts a low-frequency component and outputs the low-frequency component as the test signal. According to this configuration, since the test signal having plural frequency components is used, determination is hardly affected by the standing wave of the room. Furthermore, since the test signal from which higher frequency components are cut away is used, determination is hardly affected by the manner of placement of loudspeakers, so that, in polarity determination, it is possible to easily determine whether the test sound is localized between the left and right loudspeakers or outside the loudspeakers. In order to enable determination to be further hardly affected by the manner of placement of loudspeakers or the listening position, preferably, the cut-off frequency of the low-pass filter is set to be, for example, about 300 Hz or lower. Since a human being can hardly sense a frequency of several tens hertz or lower, the test signal may be restricted to a signal of several tens hertz or higher.

DETAILED DESCRIPTION OF THE PREFERRED EMBODIMENTS

1. First Embodiment

Figure 1:
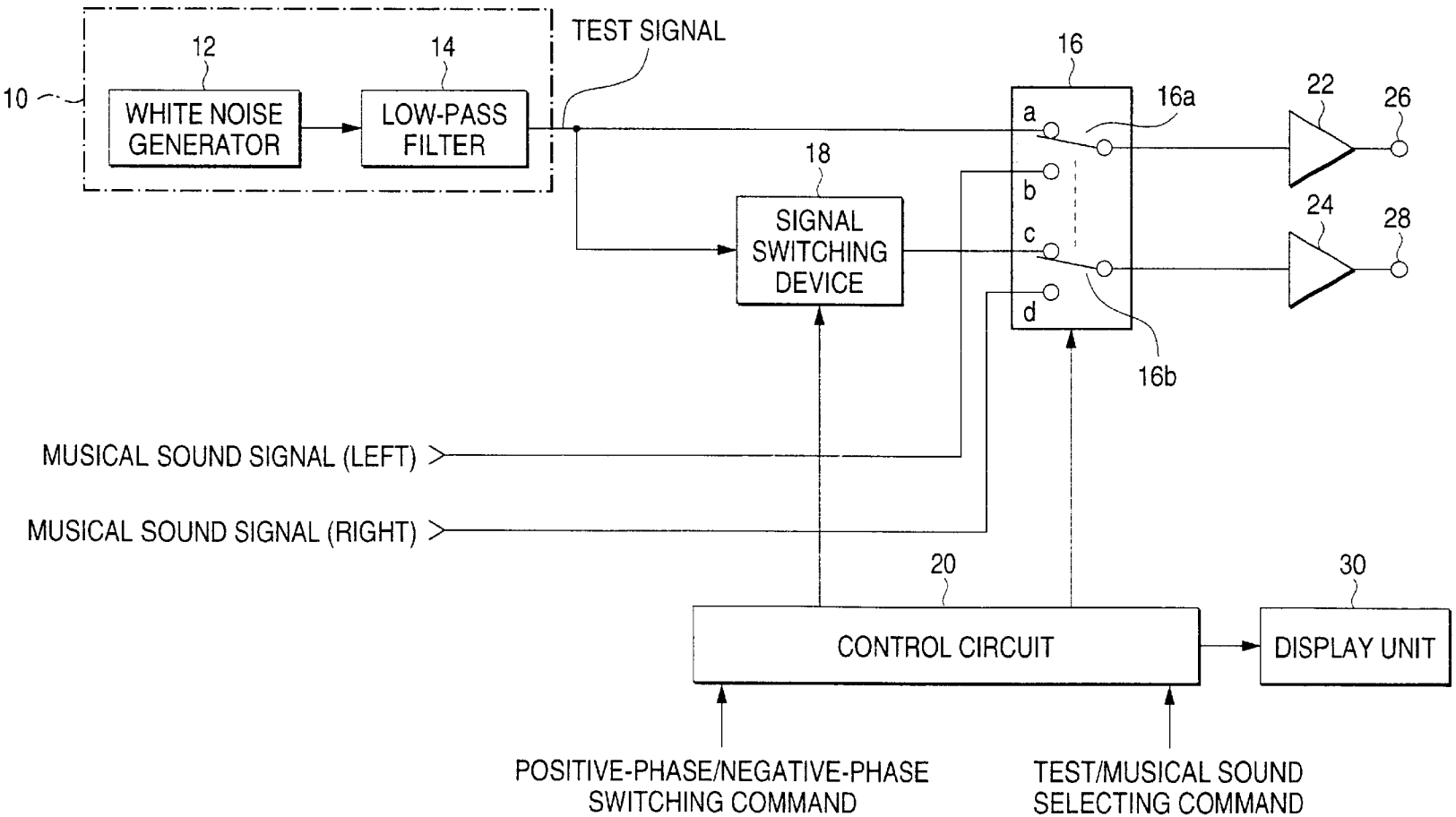
FIG. 1 is a block diagram showing a first embodiment of the present invention.

FIG. 1 shows a first embodiment of the present invention. The first embodiment is configured as an audio amplifier for a karaoke apparatus or the like. In a test signal generator 10, a white noise generator 12 generates a white noise signal. The white noise signal is passed through a low-pass filter 14 so that a low-frequency component is extracted. For example, the low-pass filter 14 may be configured as a secondary two-stage filter having a cut-off frequency of 220 Hz. The test signal output from the low-pass filter 14 is supplied as it is (i.e., as a positive-phase signal) to one contact a of one switching unit 16*a* of a selector 16. The test signal is supplied also to one contact c of another switching unit 16*b* of the selector 16 via a signal switching device 18. The signal switching device 18 selectively outputs either one of the positive-phase signal of the test signal and a negative-phase signal of the test signal, in response to commands from a control circuit 20 based on an operation of the user. The negative-phase signal can be produced by inverting the polarity of the positive-phase signal in an inverting amplifier or the like.

A musical sound signal of the left channel is supplied to the other contact b of the one switching unit 16*a* of the selector 16, and that of the right channel is supplied to the other contact d of the other switching unit 16*b* of the selector 16. The switching units 16*a* and 16*b* of the selector 16 are switched so as to be interlocked with each other, in response to commands from the control circuit 20 based on an operation of the user, thereby selectively outputting either one of the test signal and the musical sound signals. The output (left-channel output) of the switching unit 16*a* of the selector 16 and the output (right-channel output) of the switching unit 16*b* are amplified by amplifiers 22 and 24 and then supplied to left and right speaker terminals 26 and 28, respectively. A loudspeaker of the left channel is connected to the speaker terminal 26, and that of the right channel is connected to the speaker terminal 28.

In response to an operation of the user through a touch panel or the like, a test/musical sound selecting command, and a positive-phase/negative-phase switching command are supplied to the control circuit 20. When the test is selected in the test/musical sound selecting command, the selector 16 is connected to the test signal side (the contacts a and c), and, when the musical sound is selected, the selector 16 is connected to the musical sound signal side (the contacts b and d). During a test period, when the positive-phase is instructed in the positive-phase/negative-phase switching command, the signal switching device 18 outputs the positive-phase signal, and, when the negative-phase is instructed, the signal switching device 18 outputs the negative-phase signal. The set states (contents of the commands) of the signal switching device 18 and the selector 16 are displayed on a display unit (which may be used also as a touch panel) 30.

In the circuit of FIG. 1, when polarity determination is to be conducted, the selector 16 is connected to the test signal side (the contacts a and c), the test signal generator 10 generates the test signal, and the test signal is reproduced from the left and right loudspeakers respectively connected to the speaker terminals 26 and 28. Under this state, the user gives the positive-phase/negative-phase switching command, so that the positive-phase/negative-phase of the test signal output from the signal switching device 18 is switched over. The reproduced sounds which are obtained as a result of this switching are compared by hearing with each other, so that it is possible to easily determine whether the test sound is localized between the left and right loudspeakers or outside the loudspeakers. If, when the test signal is positive-phase, the test sound is localized between the left and right loudspeakers, it is determined that coincidence of the connection polarities of the left and right loudspeakers is attained. Therefore, the connections of the loudspeakers are not required to be changed. If, when the test signal is negative-phase, the test sound is localized between the left and right loudspeakers, it is determined that coincidence of the connection polarities of the left and right loudspeakers is not attained. Therefore, the connection of one of the loudspeakers is changed (i.e., the connection polarity is reversed). When the test is ended, the selector 16 is switched to the musical sound signal side (the contacts b and d) and the sound reproduction is then conducted.

2. Second Embodiment

Figure 2:
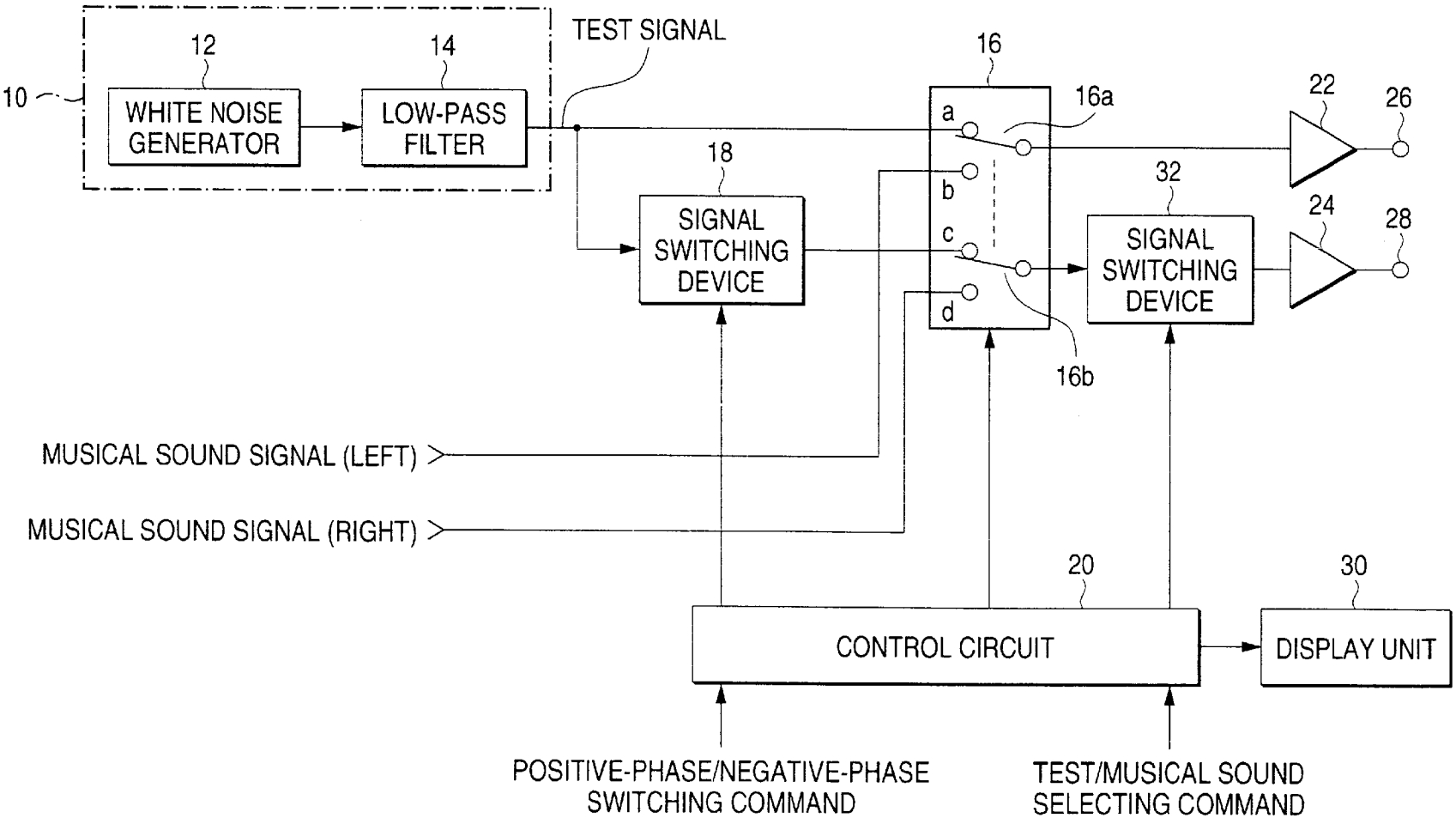
FIG. 2 is a block diagram showing a second embodiment of the present invention.

FIG. 2 shows a second embodiment of the present invention. The components identical with those of FIG. 1 are denoted by the same reference numerals. In the second embodiment, a signal switching device 32 (second signal switching device) is connected between one output of the selector 16 and the speaker terminal 28, so that the polarities of the loudspeakers can be switched over in response to commands from the control circuit 20 based on an operation of the user. The signal switching device 32 selectively outputs either one of the output signal of the switching unit 16*b* of the selector 16 as it is (positive-phase signal) and a negative-phase signal of the output signal, in response to commands from the control circuit 20 based on an operation of the user. The negative-phase signal can be produced by inverting the polarity of the positive-phase signal in an inverting amplifier or the like.

When the test is to be conducted, the signal switching device 32 is connected to the positive-phase side, the selector 16 is connected to the test signal side (the contacts a and c), and the signal switching device 18 (the first signal switching device) is switched to the positive-phase or the negative-phase. Thereafter, the test is started. If, when the test signal is positive-phase, the test sound is localized between the left and right loudspeakers, it is determined that coincidence of the connection polarities of the left and right loudspeakers is attained. Therefore, the connection of the signal switching device 32 is not required to be changed or remains positive-phase even after the test. If, when the test signal is negative-phase, the test sound is localized between the left and right loudspeakers, it is determined that coincidence of the connection polarities of the left and right loudspeakers is not attained. Therefore, the connection of the signal switching device 32 is changed to the negative-phase side during or after the test. When the test is ended, the selector 16 is switched to the musical sound signal side (the contacts b and d) and the sound reproduction is then conducted.

3. Third Embodiment

Figure 3:
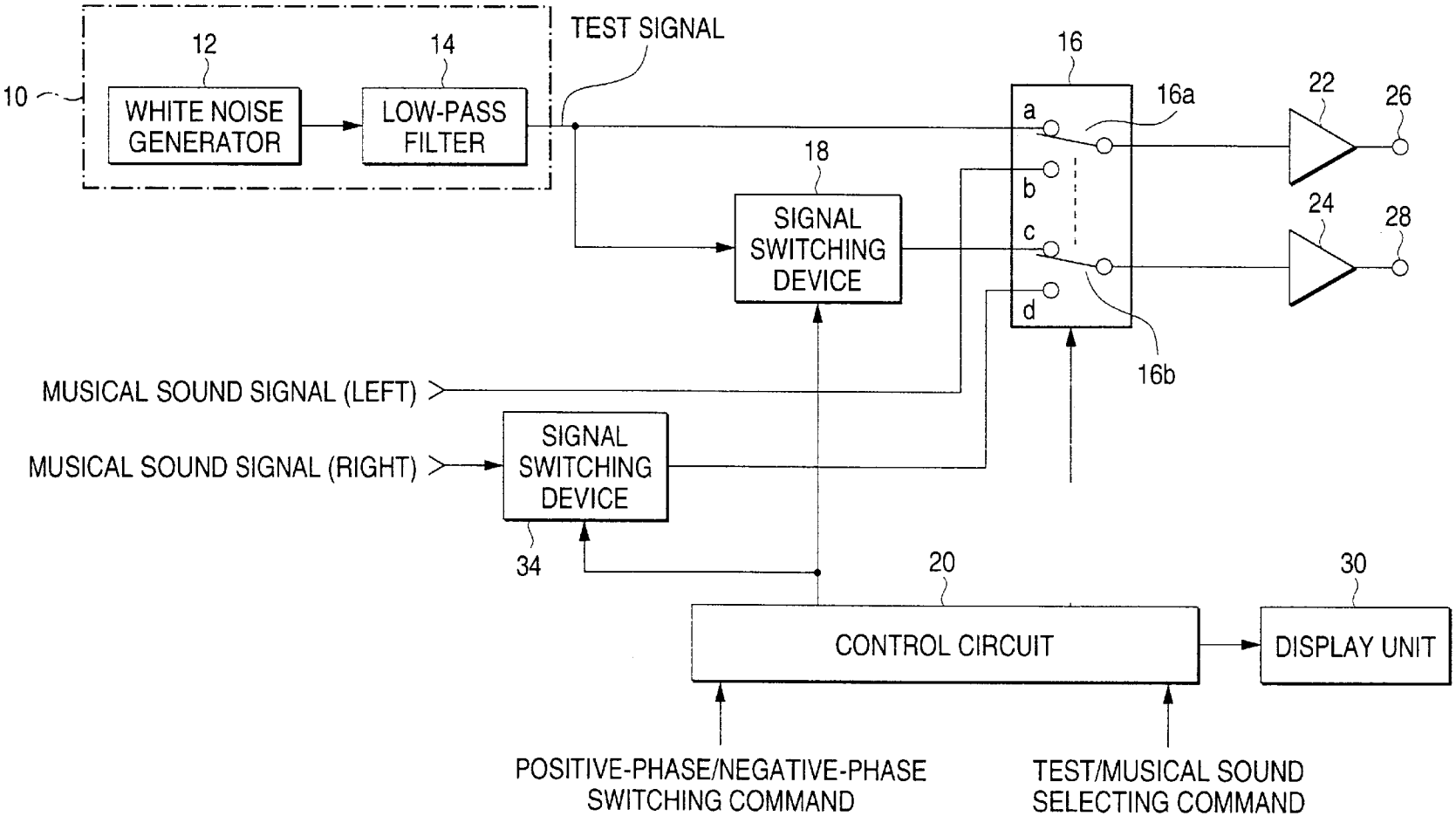
FIG. 3 is a block diagram showing a third embodiment of the present invention.

FIG. 3 shows a third embodiment of the present invention. The components identical with those of FIGS. 1 and 2 are denoted by the same reference numerals. In the third embodiment, a signal switching device 34 (second signal switching device) is connected between a musical sound signal input of one channel and the selector 16, so that the polarities of the loudspeakers can be switched over in response to commands from the control circuit 20 based on an operation of the user. The signal switching device 34 selectively outputs either one of the input musical sound signal of one channel as it is (positive-phase signal) and a negative-phase signal of the input musical sound signal, in response to commands from the control circuit 20 based on an operation of the user. The negative-phase signal can be produced by inverting the polarity of the positive-phase signal in an inverting amplifier or the like. The switching operations of the signal switching devices 18 and 34 may be interlocked with each other. In the case where the signal switching devices 18 and 34 are to be interlocked with each other, the switches are set so that, when one of the switches is in the positive-phase side, the other switch is also in the positive-phase side. Additionally, when one of the switches is in the negative-phase side, the other switch is in the negative-phase side.

When the test is to be conducted, the selector 16 is connected to the test signal side (the contacts a and c), and the signal switching device 18 is switched to either one of the positive-phase and the negative-phase. Thereafter, the test is started. If, when the test signal is positive-phase, the test sound is localized between the left and right loudspeakers, the signal switching device 34 is set to the positive-phase side. If, when the test signal is negative-phase, the test sound is localized between the left and right loudspeakers, the signal switching device 34 is set to the negative-phase side. When the test is ended, the selector 16 is switched to the musical sound signal side (the contacts b and d) and the sound reproduction is then conducted.

In the case where the signal switching devices 18 and 34 are to be interlocked with each other, the test is conducted in the following manner when the signal switching device 18 is switched to either one of the positive-phase and the negative-phase. If, when the test signal is positive-phase, the test sound is localized between the left and right loudspeakers, the selector 16 is set to the musical sound signal side (the contacts b and d) while the signal switching device 18 is maintained to be connected to the negative-phase side (at this time, also the signal switching device 34 is interlocked so as to be connected to the positive-phase side), and the sound reproduction is then conducted.

4. Fourth Embodiment

Figure 4:
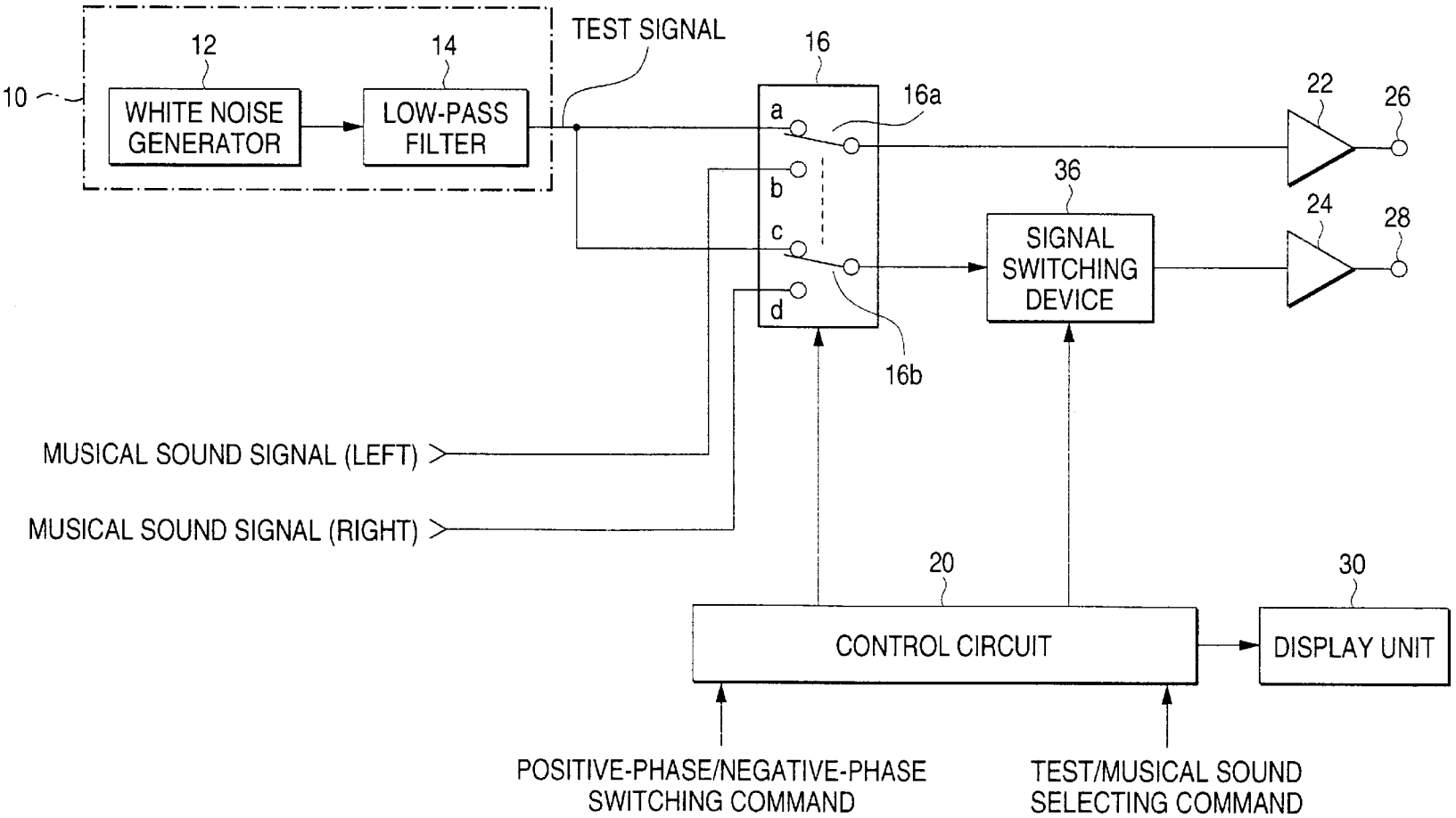
FIG. 4 is a block diagram showing a fourth embodiment of the present invention.

FIG. 4 shows a fourth embodiment of the present invention. The components identical with those of FIGS. 1, 2, and 3 are denoted by the same reference numerals. In the fourth embodiment, a signal switching device 36 is connected between one output of the selector 16 and the speaker terminal 28, so that polarity determination and polarity switching can be simultaneously conducted in response to commands from the control circuit 20 based on an operation of the user. The signal switching device 36 selectively outputs either one of the output signal of the switching unit 16*b* of the selector 16 as it is (positive-phase signal) and a negative-phase signal of the output signal, in response to commands from the control circuit 20 based on an operation of the user. The negative-phase signal can be produced by inverting the polarity of the positive-phase signal in an inverting amplifier or the like.

When the test is to be conducted, the selector 16 is connected to the test signal side (the contacts a and c), and the signal switching device 36 is switched to either one of the positive-phase and the negative-phase. Thereafter, the test is started. If, when the test signal is positive-phase, the test sound is localized between the left and right loudspeakers, the selector 16 is set to the musical sound signal side (the contacts b and d) while the signal switching device 36 is maintained to be connected to the positive-phase side. The sound reproduction is then conducted. If, when the test signal is negative-phase, the test sound is localized between the left and right loudspeakers, the selector 16 is set to the musical sound signal side (the contacts b and d) while the signal switching device 36 is maintained to be connected to the negative-phase side. The sound reproduction is then conducted.

What is claimed is:

1. A polarity determining circuit for loudspeakers, comprising:

a test signal generator which generates either one of a positive-phase signal of a test signal and a negative-phase signal of the test signal, the test signal being delivered to a signal switching device and either one of a left speaker terminal and a right speaker terminal, wherein the test signal generator includes a white noise generator which generates a white noise signal, and a low-pass filter which receives the white noise signal, and which extracts a low-frequency component of the white noise signal and outputs the low-frequency component as the test signal;

the signal switching device which, based on a switching operation of a user, selectively outputs either one of the positive-phase signal of the test signal and the negative-phase signal of the test signal as an output signal; and the left and right speaker terminals, wherein the output signal of the signal switching device is output from one of the left and right speaker terminals, and one of the positive-phase and negative-phase signals of the test signal from the test signal generator is constantly output from the other of the left and right speaker terminals.

2. An audio circuit having a function of determining polarities of loudspeakers, comprising:

a test signal generator which generates a test signal;

a signal switching device which, based on a switching operation of a user, selectively outputs either one of a positive-phase signal of the test signal and a negative-phase signal of the test signal;

a selector which, based on a selecting operation of the user, selectively outputs either one of an output test signal of the signal switching device and a musical sound signal of one of left and right channels, as a signal of the one of the left and right channels, and which, interlocked with the output, selectively outputs either one of a constant output which is one of the positive-phase and negative-phase signals of the test signal, and a musical sound signal of the other one of the left and right channels, as a signal of the other one of the left and right channels; and left and right speaker terminals from which the output signals of the left and right channels of the selector are respectively output.

3. A polarity determining circuit for loudspeakers, comprising:

a test signal generator which generates either one of a positive-phase signal of a test signal and a negative-phase signal of the test signal, wherein the test signal is generated by cutting a high-frequency component from a white noise signal, the test signal being delivered to a signal switching device and either one of a left speaker terminal and a right speaker terminal, the signal switching device which, based on a switching operation of a user, selectively outputs either one of the positive-phase signal of the test signal and the negative-phase signal of the test signal as an output signal; and the left and right speaker terminals, wherein the output signal of the signal switching device is output from one of the left and right speaker terminals, and one of the positive-phase and negative-phase signals of the test signal from the test signal generator is constantly output from the other of the left and right speaker terminals.

* * * * *